US006253763B1

(12) United States Patent
Pounders, Jr.

(10) Patent No.: US 6,253,763 B1
(45) Date of Patent: Jul. 3, 2001

(54) MOUTHPIECE AND SPEAKER ASSEMBLIES FOR UNDERWATER SPEECH

(76) Inventor: O'Neal B. Pounders, Jr., 2205 Barksdale Blvd., Bossier City, LA (US) 71112

( * ) Notice: Subject to any disclaimer, the term of this patent is extended or adjusted under 35 U.S.C. 154(b) by 0 days.

(21) Appl. No.: 09/498,106

(22) Filed: Feb. 4, 2000

Related U.S. Application Data

(60) Provisional application No. 60/119,075, filed on Feb. 8, 1999.

(51) Int. Cl.[7] ..... B63C 11/16
(52) U.S. Cl. ..... 128/201.11; 128/201.19
(58) Field of Search ..... 128/201.11, 201.19, 128/201.27, 200.29, 201.28; 367/132

(56) References Cited

U.S. PATENT DOCUMENTS 5,455,842 * 10/1995 Mersky et al. ..... 375/175
5,493,079 * 2/1996 Anderson ..... 181/127
5,579,284 * 11/1996 May ..... 367/132
5,706,251 * 1/1998 May ..... 367/132
5,825,718 * 10/1998 Ueki et al. ..... 367/132
6,018,585 * 1/2000 Akino et al. ..... 381/355

* cited by examiner

*Primary Examiner*—Dennis Ruhl
*Assistant Examiner*—Teena K. Mitchell
(74) *Attorney, Agent, or Firm*—John M. Harrison

(57) ABSTRACT

Mouthpiece and speaker assemblies for underwater speech using SCUBA and snorkel equipment, which mouthpiece is characterized by a molded rubber or plastic mouthpiece having a regulator or snorkel connector, a lip cup and a pair of elongated, serpentine or curved teeth grips or bites extending from the lip cup for gripping by the jaw teeth of a SCUBA diver or snorkeler and facilitating movement of the lips to enable underwater speech. The mouthpiece is designed for attachment directly to an underwater speaker, a snorkel, a snorkel and speaker combination, or to the mouthpiece of a conventional second-stage regulator and speaker combination. The underwater speaker includes a pair of flexible membranes connected at a common perimeter and designed to pulse and flex responsive to the pressure pulses of a diver or snorkeler's breath and voice.

20 Claims, 7 Drawing Sheets

MOUTHPIECE AND SPEAKER ASSEMBLIES FOR UNDERWATER SPEECH

CROSS-REFERENCE TO RELATED APPLICATIONS

This application claims the benefit of copending U.S. Provisional Application Serial No. 60/119,075, filed Feb. 8, 1999.

BACKGROUND OF THE INVENTION

FIELD OF THE INVENTION

This invention relates to diving equipment, including SCUBA (self-contained underwater breathing apparatus) diving equipment having a compressed air tank and regulator, as well as shallow water diving equipment such as a snorkel. More particularly, the invention relates to a mouthpiece for attachment to an underwater speaker or to a SCUBA diving regulator, with or without an underwater speaker, or a snorkel with or without an underwater speaker, to facilitate underwater speech. The mouthpiece of this invention is designed to be used in two positions. The first position conventionally used in normal SCUBA and snorkel diving includes placing the lips over the outside convex curvature of the mouthpiece lip cup, leaving the edge of the lip cup between the lips and gums of the diver. In a second or "talk" position, the lips are typically retracted behind the lip cup into the concave curvature of the lip cup and the jaw teeth are tightened on a pair of elongated, functionally shaped jaw teeth grips or bites extending from the lip cup rearwardly of the mouthpiece to match the bite of the jaw or molar teeth and facilitate movement of the lips and underwater conversation. The underwater speaker is characterized by dual, flexible membranes attached at a common perimeter and designed to pulse and flex in response to the diver or snorkeler's breath and speech to facilitate substantial matching of the internal air and external water impedance and allow underwater enunciation.

One of the problems which has long been apparent in diving, including SCUBA diving, as well as snorkeling and free diving, is the inability to effectively communicate while the diver's head is underwater. This difficulty is in part, the result of conventional diving mouthpieces which are typically mounted on the regulator of the SCUBA gear and the bottom end of the snorkeling tube, which mouthpieces tend to maintain the lips in a fixed position over the convex surface of the curved lip cup of the mouthpiece. Since the conventional mouthpiece teeth grips are short and designed for engagement primarily by the front teeth, the lips are not free to articulate and form words while positioned over the convex outer surface of the mouthpiece.

Since the acoustic impedance of air and water is different, speech in the air medium by a diver tends to reflect from a membrane or diaphragm separating the air medium from the water environment in various prior art devices. The flexible dual diaphragms in the underwater speaker of this invention, especially when used with a specially designed mouthpiece, facilitates substantial matching of these dissimilar impedances by a dual pulsing and flexing action and allows clear underwater speech.

It is therefore an object of this invention to provide a mouthpiece for underwater speech, which mouthpiece is designed to mount the regulator of a SCUBA diving apparatus or the bottom end or mouthpiece receptacle of a snorkeling tube, and has rearwardly-extending, elongated, serpentine or curved jaw teeth grips of sufficient length and curvature to substantially match the molar teeth configuration and facilitate freeing the lips while maintaining the mouthpiece in position at the mouth and allowing underwater conversation.

Another object of this invention is to provide a new and improved, mechanically voice-driven underwater speaker for undertaking underwater speech, which is used with a mouthpiece designed to mount on the second stage regulator of a SCUBA diving apparatus and the bottom end of a snorkeling tube apparatus and/or directly on the dual membrane underwater speaker, the mouthpiece also typically fitted with a connector for attachment to the regulator or snorkel, a lip cup extending from the connector and a pair of shaped, serpentine or curved elongated jaw teeth grips or bites extending from the lip cup for gripping by the jaw teeth and facilitating movement and articulation of the lips and resulting underwater conversation while the mouthpiece is still in position at the diver's mouth. The underwater speaker is attached to the mouthpiece, either in connection with a second stage regulator or a snorkel, such that the pair of flexible membranes, joined at a common perimeter, may fill with air, pulse and flex without stretching or resonating, responsive to the diver or snorkeler's breath and speech.

Still another object of the invention is to provide new and improved, flexible, resilient mouthpiece, underwater speaker and snorkel assemblies, which mouthpiece has a conventional regulator/snorkel connector for attachment to a conventional SCUBA diving regulator or snorkeling tube, a convex/concave lip cup extending from the regulator/snorkel connector and a pair of typically serpentine or curved jaw teeth grips extending from the concave side of the lip cup to allow gripping of the elongated teeth grips or bites by the jaw teeth and retraction of the lips from the convex surface to the concave surface behind the lip cup, thus freeing the lips for articulation and underwater conversation by continued gripping of the teeth grips with the jaw teeth. The underwater speaker includes flexible elements, diaphragms or membranes, joined at a common perimeter and designed to expand and partially deflate, flex or pulse with the air pressure or pulsation of the diver or snorkeler's breath and voice as he or she speaks beneath the surface of the water.

SUMMARY OF THE INVENTION

These and other objects of the invention are provided in a new and improved flexible, resilient, typically rubber or plastic mouthpiece which is compatible with a membrane or diaphragm pulsating underwater speaker of special design, the regulator of a SCUBA diving apparatus and the mouthpiece receptacle or bottom end of a snorkeling tube. The mouthpiece includes a lip cup having a convex outer surface with a thin edge margin for normally receiving the lips of a diver and a concave inner surface and further includes a pair of rearwardly-extending, elongated, typically curved or serpentine jaw teeth grips or bites attached to the lip cup. The underwater speaker is typically, but not necessarily used with the specially designed mouthpiece, and includes a housing or grill that accommodates a pair of flexible membranes or diaphragms joined at a common perimeter, which membranes fill with air and pulsate and flex together in response to the air pressure fluctuations of the diver or snorkeler's breath and voice, to substantially match the internal air and external water impedance and facilitate discernable underwater speech. Accordingly, when these devices are used together, the diver may retract the lips from the convex surface to the concave surface behind the lip cup of the mouthpiece, grip the extending jaw teeth bites with the jaw teeth and thereby facilitate underwater conversation by movement and articulation of the lips in speech to effect pulsation and flexure of the dual membranes, with the mouthpiece still in place.

BRIEF DESCRIPTION OF THE DRAWINGS

The invention will be better understood by reference to the accompanying drawings, wherein.

DESCRIPTION OF THE PREFERRED EMBODIMENTS

Figure 1:
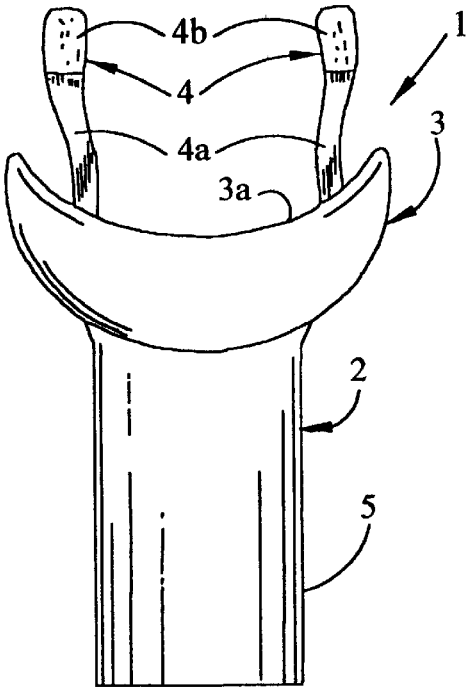
FIG. 1 is a top view of the mouthpiece for underwater speech of this invention for connection to the regulator of a SCUBA diving apparatus or the bottom end of a snorkeling tube and accommodating the mouth of a diver.
Figure 1A:
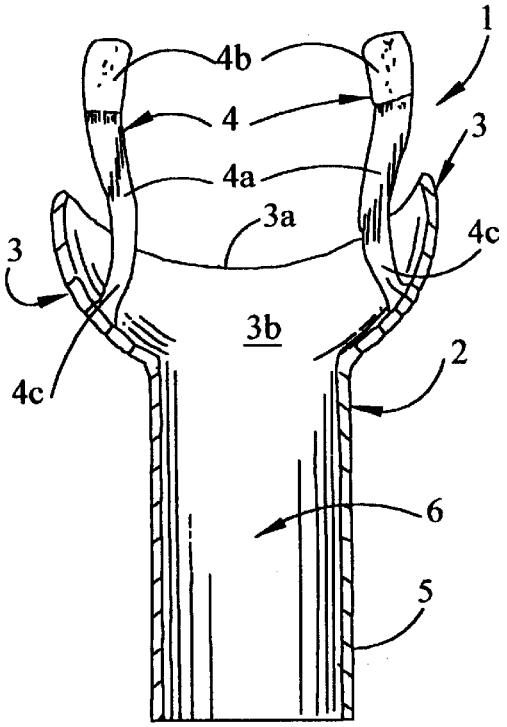
FIG. 1A is a longitudinal sectional view of the mouthpiece illustrated in FIG. 1.
Figure 2:
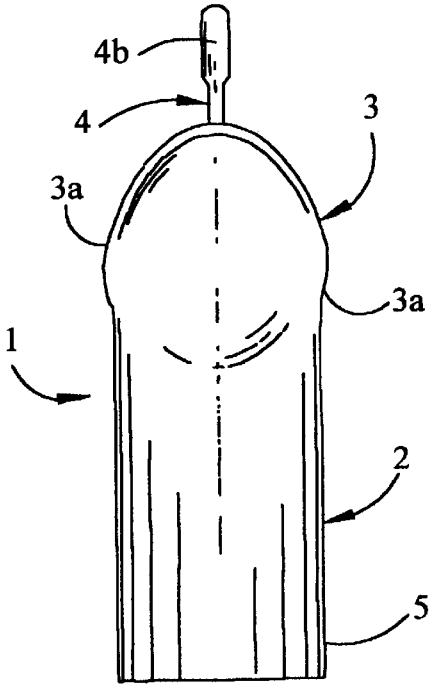
FIG. 2 is a side view of the mouthpiece illustrated in FIG. 1.
Figure 2A:
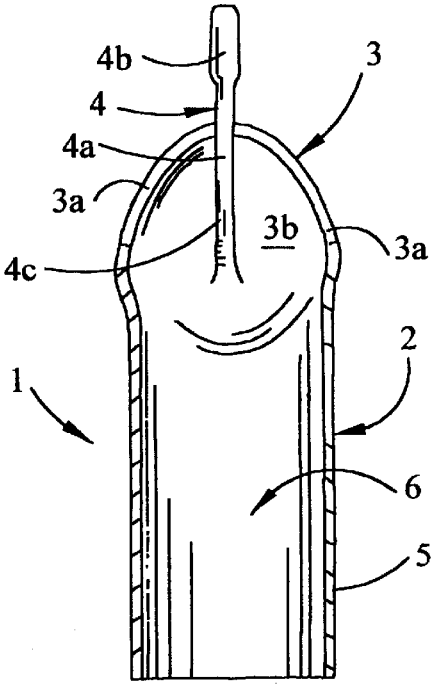
FIG. 2A is a longitudinal sectional view of the mouthpiece illustrated in FIG. 2.
Figure 3:
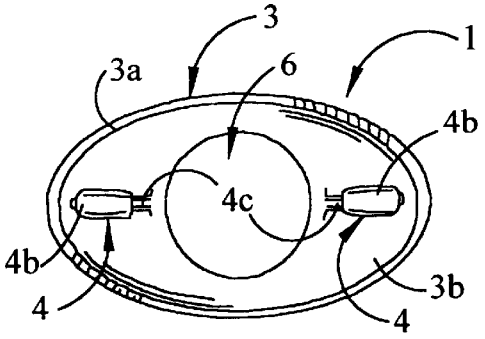
FIG. 3 is a user end view of the mouthpiece for underwater speech, further illustrating the lip cup and jaw teeth bites.

Referring initially to FIGS. 1–5 of the drawings, in a preferred embodiment the mouthpiece for underwater speech of this invention is generally illustrated by reference numeral 1 and includes a flexible, resilient, typically molded rubber or plastic body 2, having a regulator/snorkel connector 5 and a curved lip cup 3, which includes a convex, thin cup margin 3*a* and a concave inside surface 3*b*. A common connector plenum 6 extends through the regulator/snorkel connector 5 and the lip cup 3, as further illustrated in FIGS. 1A and 2A.

Figure 4:
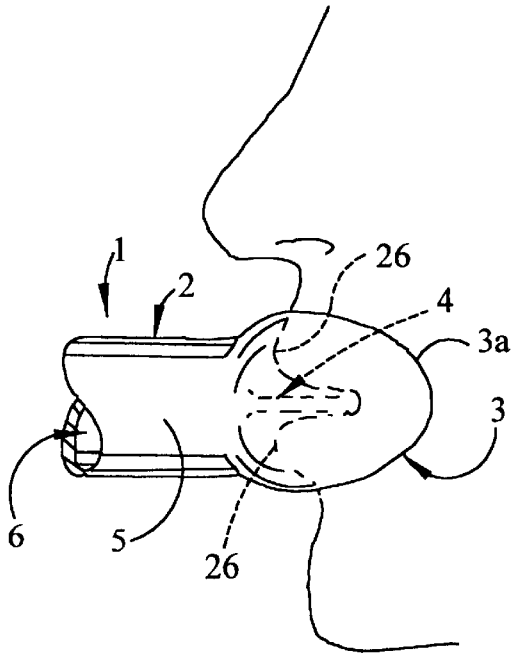
FIG. 4 is a side view of the mouthpiece illustrated in speech configuration, with the lips inside the lip cup.
Figure 5:
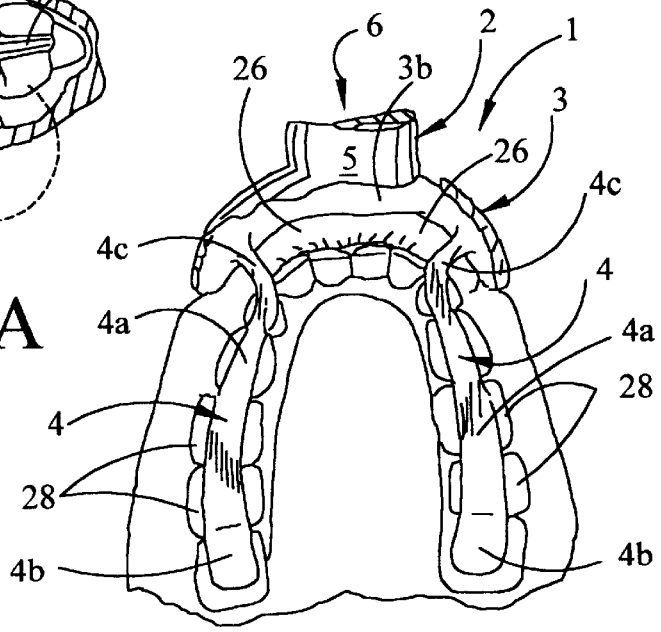
FIG. 5 is a top view, partially in section, of the mouthpiece for underwater speech in the speech configuration illustrated in FIG. 4A.
Figure 6:
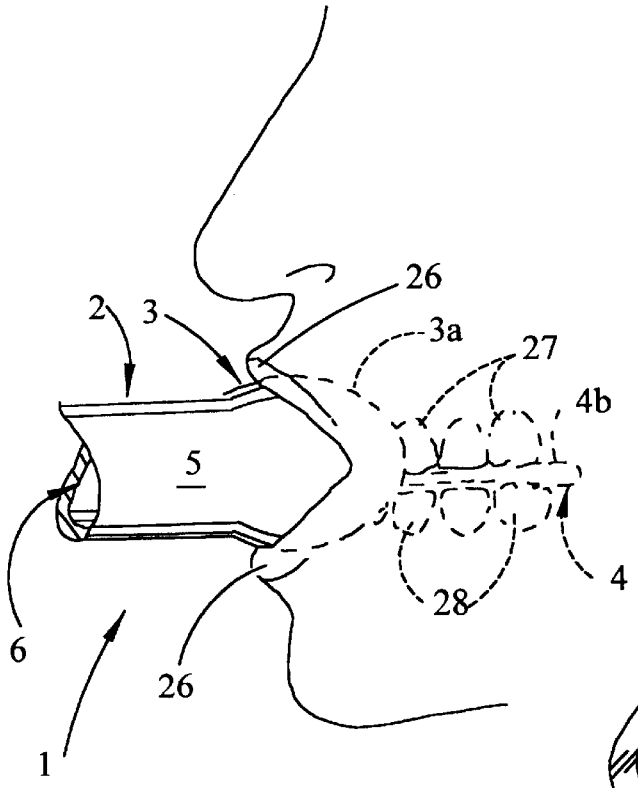
FIG. 6 is a side view of the mouthpiece for underwater speech illustrated in FIGS. 1–5 in conventional diving or snorkeling use, with the lip cup positioned inside the diver or snorkeler's mouth and the shaped jaw teeth bites typically selectively engaged or disengaged by the jaw teeth.

Referring to FIGS. 1–6 of the drawings, a pair of elongated, serpentine or curved jaw teeth bites 4 extend rearwardly from the lip cup 3 for gripping by the jaw teeth of a diver or snorkeler under circumstances where the mouthpiece 1 is in the configuration for speaking underwater, as hereinafter further described. The jaw teeth bites 4 are typically characterized by bite stems 4*a* which are narrow at the stem base 4*c*, extend through the corners of the mouth and expand in size and curve to terminate at the wider and thicker bite panels 4*b*, for matching and comfortable gripping by the upper molar teeth 27 and lower molar teeth 28, as illustrated in FIGS. 4–6.

Figure 12:
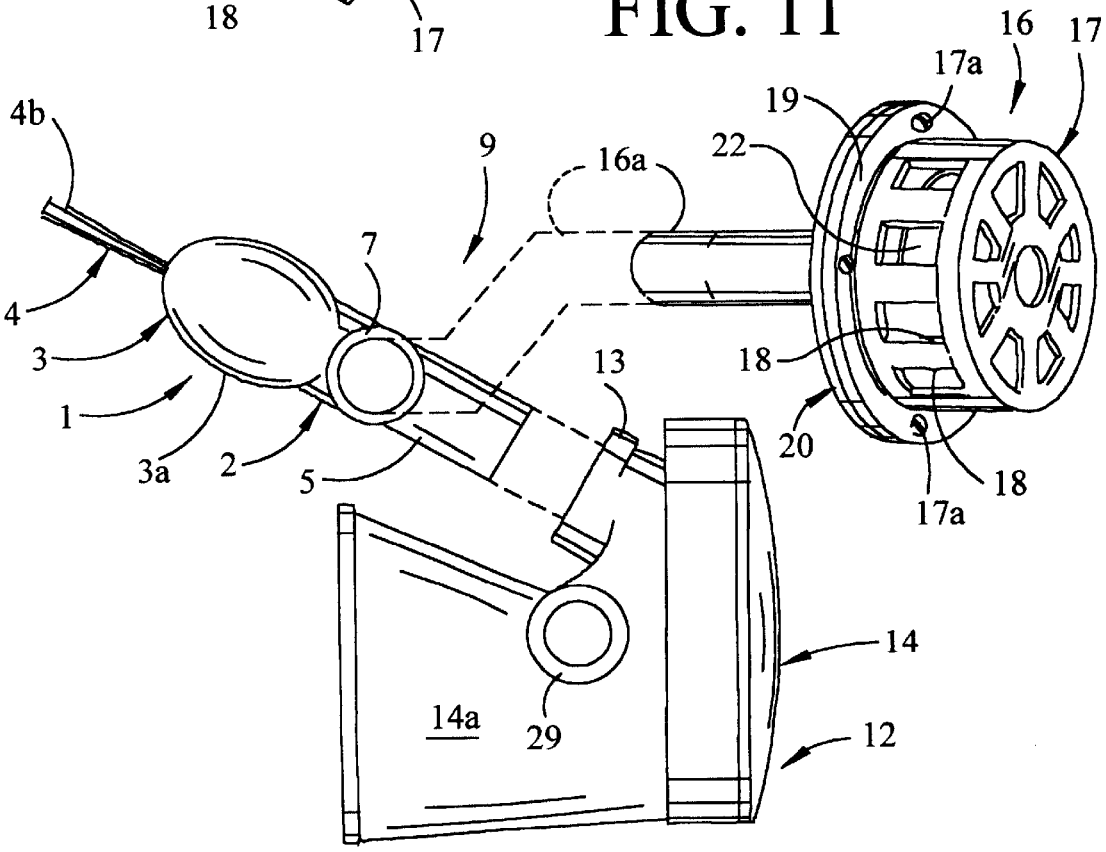
FIG. 12 is a side view of the regulator, mouthpiece and underwater speaker combination illustrated in FIG. 11.
Figure 13:
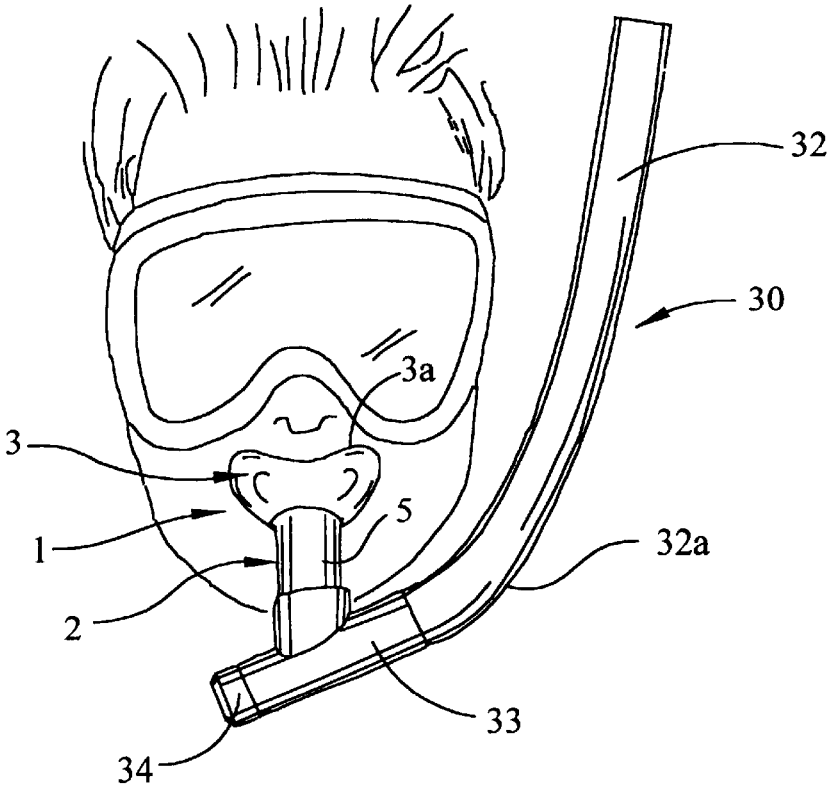
FIG. 13 is a perspective view of the mouthpiece for underwater speech of this invention attached to a snorkel.
Figure 14:
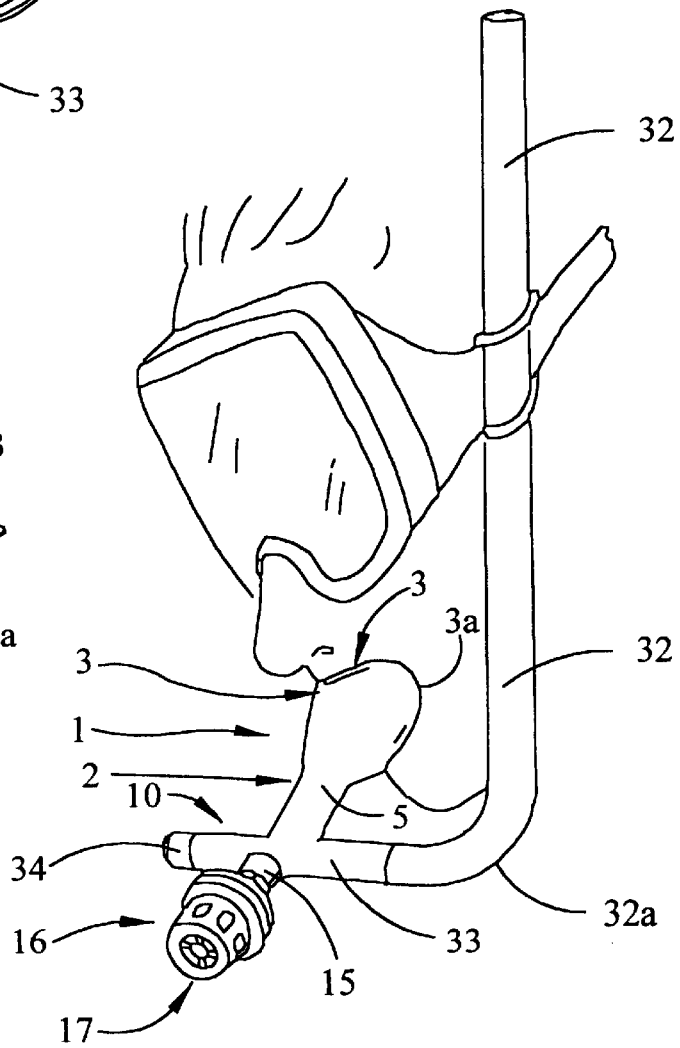
FIG. 14 is a perspective view of a mouthpiece and underwater speaker combination fitted to a snorkel.

Referring next to FIG. 13 of the drawings, a snorkel tube 32 of a snorkel 30 is illustrated extending upwardly from a mount tee 33, thus illustrating that the mouthpiece 1 may be attached to the mount tee 33, for use during snorkeling operations, as desired. Accordingly, referring again to FIGS. 4, 4A and 5 of the drawings, under circumstances where it is desired to speak underwater, the diver or snorkeler initially grips the mouthpiece 1 by tightening the upper teeth 27 and lower teeth 28 on the teeth bites 4 when the mouthpiece 1 is attached to a diving regulator 12 (illustrated in FIGS. 11 and 12) in a scuba diving apparatus or a corresponding mount tee 33 attached to a snorkel tube 32, as illustrated in FIGS. 13 and 14. The lips 26 of the diver or snorkeler are retracted from the convex surface of the lip cup 3 into the concave surface 3*b*, as further illustrated in FIGS. 4 and 4A, with the jaw molar teeth firmly engaged with the curved, matching teeth bites 4 in the mouthpiece 1, to free the lips 26 for talking. Consequently, it will be appreciated by those skilled in the art that while the jaw molars of the diver or snorkeler are tightly clamped on the matching teeth bites 4, the lips 26 are free to move and articulate, thus greatly improving the quality of speech while the diver is underwater. When conversation is terminated, the lips 26 of the diver or snorkeler may again be extended around the outside, or convex surface of the lip cup 3 in conventional fashion, as illustrated in FIG. 6, with little effort and without the requirement of using either hand. Since the lip motion of the lips 26 on the lip cup 3 of the mouthpiece 1 can be effected without the use of the hands due to the position of the upper teeth 27 and the lower teeth 28 on the shaped teeth bite grips 4, speaking can be effected underwater while both hands are occupied in any task at hand.

It will be further appreciated that the mouthpiece 1 of this invention can be constructed of rubber, plastic or other resilient material well known to those skilled in the art and with the elongated, shaped teeth bites 4 typically molded integrally with the lip cup 3 and the regulator/snorkel connector 5 of the body 2, further according to techniques well known to those skilled in the art.

Figure 7:
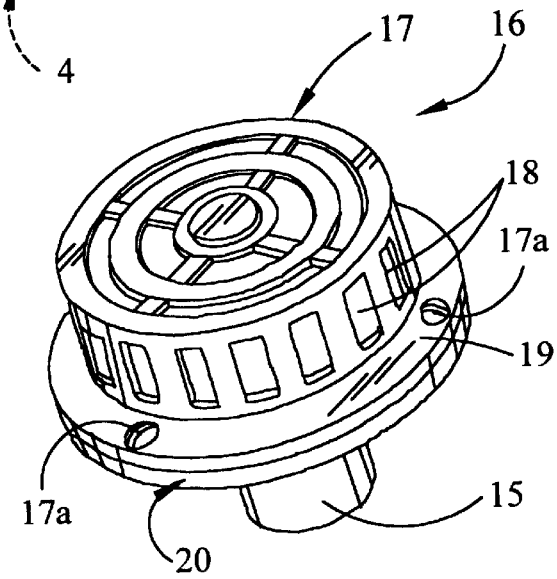
FIG. 7 is a perspective view of a typical underwater speaker of this invention.
Figure 8:
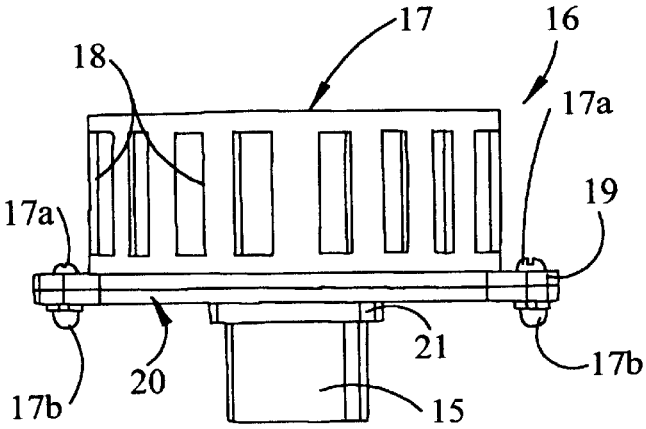
FIG. 8 is a side view of the underwater speaker illustrated in FIG. 7.
Figure 10:
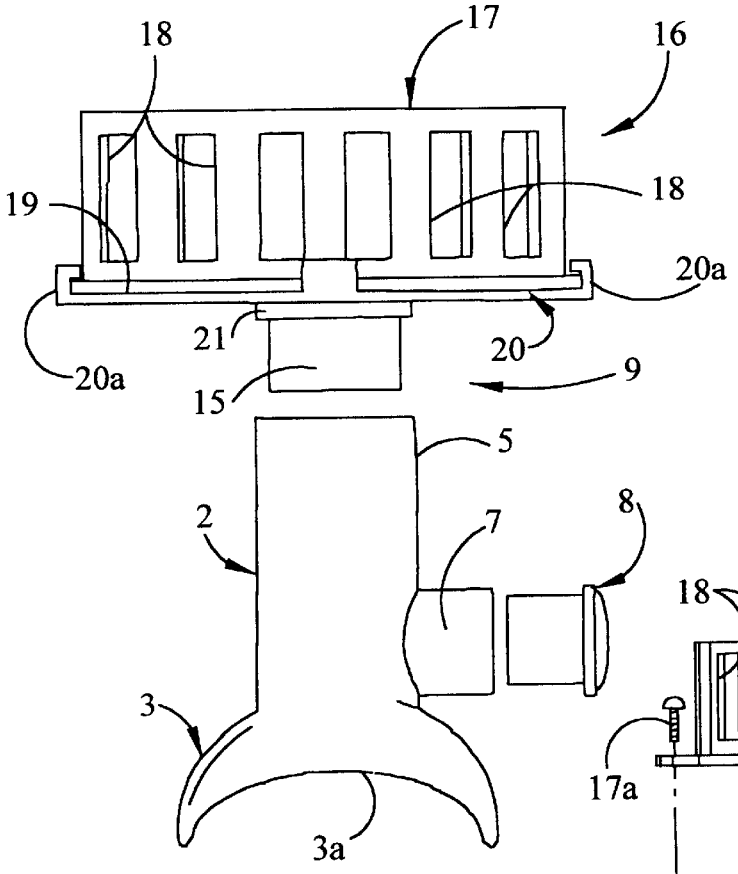
FIG. 10 is an exploded view of the assembled underwater speaker and mouthpiece combination illustrated in FIG. 9.
Figure 9:
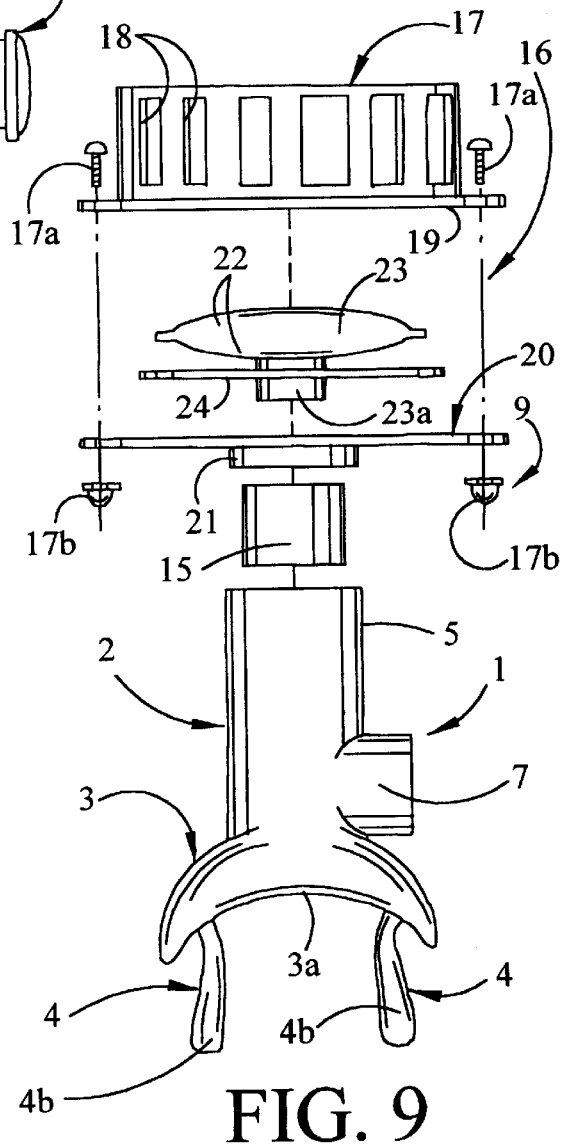
FIG. 9 is an exploded view of an underwater speaker and mouthpiece combination of this invention.

In another preferred embodiment of the invention the mouthpiece 1 may be used in connection with the underwater speaker 16 in a portable, hand-held mouthpiece and speaker assembly 8, as illustrated in FIGS. 7–10. As illustrated, the speaker 16 is characterized by a speaker housing or grill 17, having housing slots 18 and typically fitted with a housing flange 19 that bolts or snaps onto a corresponding housing base 20, typically by means of mount bolts 17*a* and corresponding nuts 17*b*, as illustrated in FIGS. 7–9. A connector nipple 15 typically extends from a base flange 21, attached to the housing base 20, for the purpose of extending into the body 2 of the mouthpiece 1 and typically removably attaching the speaker 16 to the mouthpiece 1. Alternatively, as illustrated in FIG. 10, the speaker housing 17 may be attached to the underlying housing base 20 by means of a flange retainer 20*a*, shaped in the housing base 20, which flange retainer 20*a* typically receives the housing flange 19 in bayonetcoupling fashion. Other techniques may be used according to the knowledge of those skilled in the art to connect the housing base 20 to the speaker housing 17, and facilitate use of the mouthpiece and speaker assembly 8 as a hand-held assembly, as desired.

Referring again to FIG. 9 of the drawings, a pair of flexible, water-tight, bellows-like membranes 22 are located inside the speaker housing 17 of the speaker 16 in the hand-held mouthpiece and speaker assembly 8 and the diaphragms or membranes 22 are attached to each other at a common membrane perimeter 23. A membrane mount 23*a* typically extends through and is attached to, or formed integrally with, a mount plate 24, and the bottom one of the membranes 22 is secured to the mount plate 24, typically by means of glue or an epoxy compound, in non-exclusive particular, as desired. Accordingly, when the membranes 22 are assembled inside the speaker housing 17 of the speaker 16, the connector nipple 15 may be extended through the base flange 21 of the housing base 20 and also into the regulator/snorkel connector 5 of the body 2 of the mouthpiece 1, to connect the membranes 22 to the mouthpiece 1, such that the membranes 22 are in air communication with the mouthpiece 1. Since the watertight membranes 22 fill with air and pulsate and flex sympathetically in response to the changes in air pressure of the diver or snorkeler's voice underwater, this pulsation substantially matches the internal air and external water impedance and permits the sound to travel across the membranes 22, through the water and the housing slots 18 in the speaker housing 17, to another diver or snorkeler in the area. Since it is well known that sound travels well through water, the matched impedance sound in the air-filled pulsating and flexing membranes 22 is caused to travel with a high degree of clarity to the listener or listeners in the area.

Figure 11:
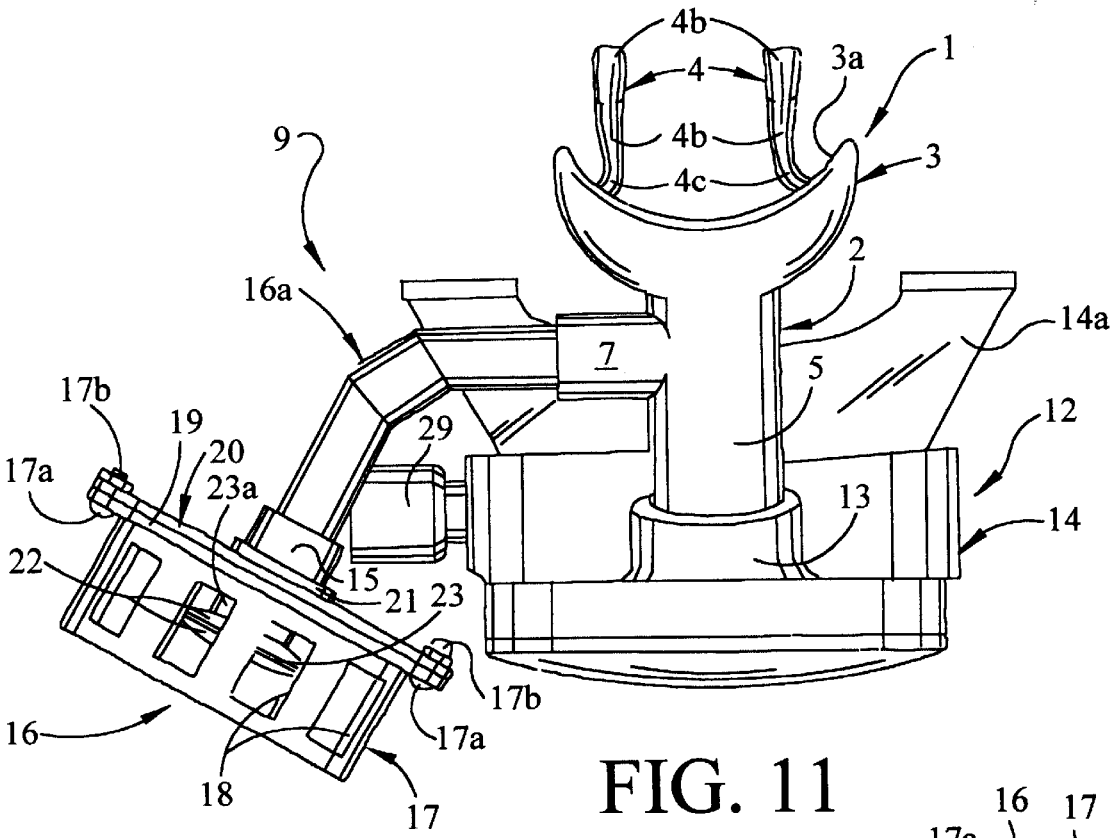
FIG. 11 is a top view of a conventional second stage diving regulator with the mouthpiece connected thereto and the underwater speaker attached to the mouthpiece in an extended configuration.

Referring now to FIGS. 11 and 12 of the drawings, in a typical mouthpiece, speaker and SCUBA assembly 9, the mouthpiece 1 is attached directly to the conventional diving regulator 12, as heretofore described and a speaker 16 is attached to the mouthpiece 1, typically by means of a speaker mount tube 16*a*. In preferred embodiment one end of the speaker mount tube 16*a* extends into a nipple 7 provided on the regulator/snorkel connector 5 of the body 2 of the mouthpiece 1 and the opposite end of the speaker mount tube 16*a* extends into the connector nipple 15 of the housing base 20. The membranes 22 illustrated in FIG. 9 are enclosed within the speaker housing 17, as heretofore described. Positioning of the speaker 16 on the speaker mount tube 16*a* has a primary advantage for the diver. Since the speaker mount tube 16*a* is typically removably extended into the nipple 7 of the mouthpiece 1 and into the connector nipple 15 of the speaker 16, the speaker 16 can be maneuvered into substantially any position with respect to the diving regulator 12 and the mouthpiece 1 by rotating the speaker 16 in a 360-degree circle as the speaker mount tube 16*a* rotates inside the connecting nipple 7. Accordingly, it will be appreciated that these speaker mount tubes 16*a* can be of any desired length and shape, although the slightly "dog leg" shape illustrated in FIGS. 11–12 is preferred for positioning purposes. It will be appreciated from a consideration of FIGS. 11 and 12 that speaking can be accomplished using the mouthpiece 1 as described above with the lips formed in the lip cup 3 in the position illustrated in FIGS. 4 and 4A and the upper teeth 27 and lower teeth 28 gripping the extending teeth bites 4. Enunciation of the diver is then effected with the sound extending into the body 2 of the mouthpiece 1 and through the nipple 7, the speaker mount tube 16*a* and to the pulsating and flexing membranes 22, as heretofore described. This pulsation and flexure set up by the breath and voice of the diver projects through the water and the housing slots 18 of the speaker housing 17 to submerged hearers in the vicinity.

Figure 4A:
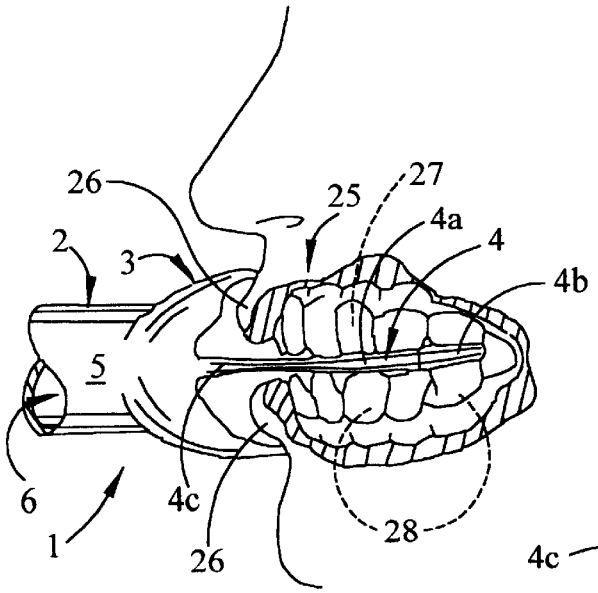
FIG. 4A is a sectional view of the mouthpiece in speech configuration illustrated in FIG. 4, with the jaw teeth bites engaged by the teeth.

Similarly, referring now to FIGS. 9 and 14 of the drawings, in a mouthpiece, speaker and snorkel assembly 10 illustrated in FIG. 14, the speaker 16 is attached to the mount tee 33, which is fitted with a T-plug 34 at one end, the opposite end of which extends at the tube bend 32*a* to define the snorkel tooth 32. Pulsation of the speaker's voice in the flexing membranes 22 (FIG. 9) of the speaker 16 is effected in the manner described above. Consequently, the snorkeler can submerge his or her head, arrange his or her lips in the lip cup 3 of the mouthpiece 1 as illustrated in FIGS. 4 and 4*a* and speak to submerged divers or snorkelers by enunciating into the mouthpiece 1, which enunciation sets up a sympathetic air pulsation in the respective membranes 22, enclosed in the speaker housing 17, to effect the desired underwater speech.

Figure 15:
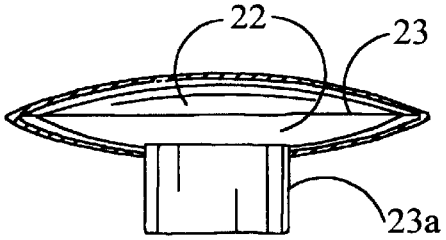
FIG. 15 is a side view of a pair of first preferred membrane or diaphragm elements of an underwater speaker of this invention.
Figure 16:
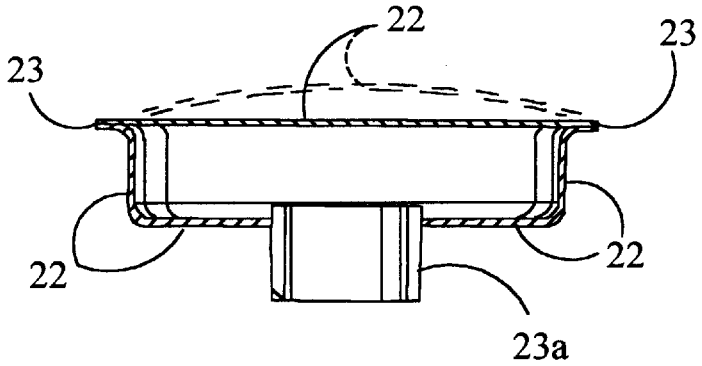
FIG. 16 is a side view of second preferred membrane or diaphragm elements of an underwater speaker.
Figure 17:
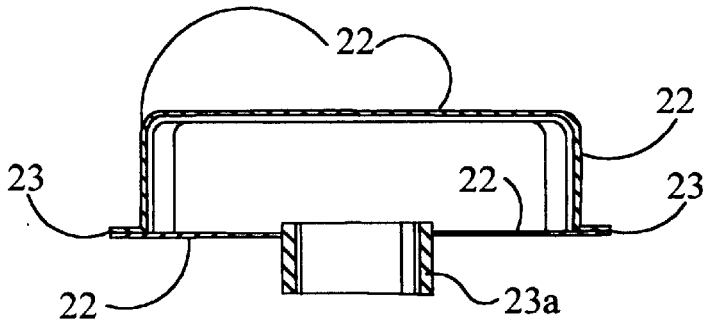
FIG. 17 is a side view of third preferred membrane or diaphragm elements of an underwater speaker.
Figure 18:
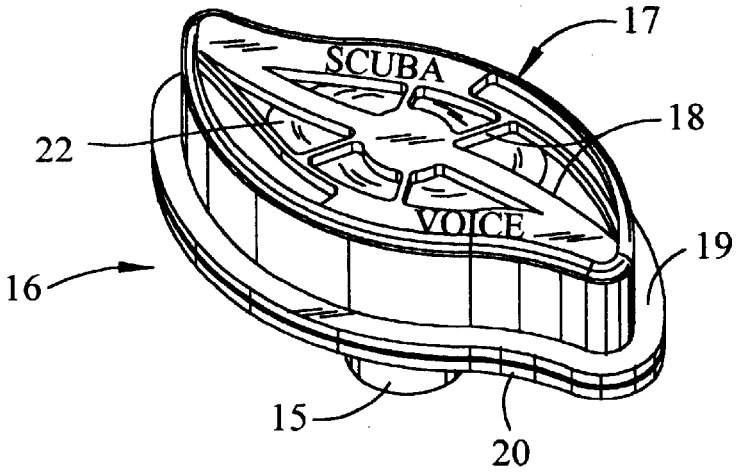
FIG. 18 is a perspective view of an alternative configuration for the underwater speaker.

As further illustrated in FIGS. 15, 16 and 17, the watertight, flexible membranes 22 may be designed in several different configurations, of which the three configurations noted in the drawings is illustrative. FIG. 15 illustrates the membranes 22 also illustrated in FIGS. 9 and 11 and consists of a pair of membranes 22, joined at a common membrane perimeter 23, the bottom membrane 22 also connected to the membrane mount 23*a*, as illustrated. In FIG. 16, a substantially planar top membrane 22 is attached to a generally U-shaped bottom membrane 22, the bottom membrane 22 of which is also attached to the membrane mount 23*a*. Air-pulsation of the two membranes 22 is effected, the top membrane 22 pulsating and flexing from a membrane perimeter 23 and the bottom membrane 22 also pulsating and flexing from the membrane perimeter 23 and at the perimeter of the junction between the bottom membrane 22 and the membrane mount 23*a*. In FIG. 17 the configuration of the membranes 22 illustrated in FIG. 16 is reversed, such that the generally inverted U-shape top membrane 22 pulsates with air pressure and flexes at the membrane perimeter 23, while the bottom generally coplanar membrane 22 pulsates and flexes, not only at the membrane perimeter 23, but also at the perimeter of attachment between the bottom membrane 22 and the corresponding membrane mount 23*a*.

It will be further appreciated by those skilled in the art that the respective membrane 22 elements of the speaker 16 of this invention are flexible and may be designed to pulsate and flex, but not oscillate, stretch or resonate, in order to facilitate a mechanical system which enables pulsation and flexure sympathetically in response to the pulsation of an underwater speaker. Accordingly, it has been found that each flexible membrane 22 may have a thickness, typically in the range from about 0.005 of an inch to about 0.020 of an inch and may be constructed of plastic or metal. The size of the membrane 22 may typically be in the range of from about one inch to about three inches and preferably about two inches, although it will be appreciated by those skilled in the art that other sizes will successfully pulsate and flex in response to resonate an underwater speaker's words in an efficient manner. Furthermore, all connections between the mouthpiece 1 and the speaker 16 and diving regulator 12, as well as the mount tee 33 of the snorkel 30, may typically be designed as a "slip", or "friction fit" to facilitate ease in assembly and disassembly.

It will be further appreciated that the speaker 16 can be used in combination with mouthpieces other than the mouthpiece 1. For example, the mouthpiece detailed in U.S. Pat. No. 4,031,888 can be used with the speaker 16, to facilitate underwater speech using the pulsating membranes 22, as described above.

While the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. A mouthpiece and speaker assembly for use with diving equipment and facilitating underwater speech by a diver using such diving equipment, said mouthpiece and speaker assembly comprising a lip cup for receiving the lips of the diver; a connector provided in air communication with said lip cup for connecting said lip cup with the diving equipment, wherein said connector defines a first air flow passage between said lip cup and the diving equipment; a pair of spaced-apart, elongated teeth grips extending from said lip cup and terminating at extending ends for gripping by the teeth of the diver and facilitating underwater speech; and a speaker provided in air communication with said connector for transferring sound waves from said lip cup to the water and facilitating the underwater speech, said connector defining a second air flow passage between said lip cup and said speaker with said second air flow passage at least partially separated from said first air flow passage, whereby air flows from the diving equipment to said lip cup through said first air flow passage and the sound waves travel from said lip cup to said speaker through said second air flow passage and enter said speaker separated from said first air flow passage.

2. The mouthpiece and speaker assembly of claim 1 wherein said elongated teeth grips are substantially flat and enlarged at the extending end thereof and are shaped to accommodate the teeth of the diver.

3. The mouthpiece and speaker assembly of claim 1 comprising a nipple provided in said connector for connecting said speaker to said connector and wherein said second air flow passage is defined by said nipple.

4. The mouthpiece of claim 1 wherein said elongated teeth grips are substantially flat and enlarged at the extending end thereof and are substantially reverse-curved to accommodate the teeth of the diver, and comprising a nipple provided in said connector for connecting said speaker to said connector and wherein said second air flow passage is defined by said nipple.

5. The mouthpiece and speaker assembly of claim 1 wherein said speaker comprises a housing provided in air communication with said connector and having at least one opening for receiving water, and a pair of flexible membranes sealed to each other at a common perimeter in said housing and provided in air communication with said lip cup for pulsing of said membranes responsive to the sound waves and transmitting the sound waves through the water.

6. The mouthpiece and speaker assembly of claim 5 wherein said elongated teeth grips are substantially flat and enlarged at the extending end thereof and are shaped to accommodate the teeth of the diver.

7. The mouthpiece of claim 5 comprising a nipple provided on said connector and wherein said speaker is attached to said nipple and said second air flow passage is defined by said nipple.

8. The mouthpiece of claim 5 wherein said elongated teeth grips are substantially flat and enlarged at the extending end thereof and are substantially reverse-curved to accommodate the teeth of the diver and comprising a nipple provided on said connector and a purge valve provided in said nipple and wherein said speaker is attached to said nipple.

9. A mouthpiece and speaker assembly in combination with SCUBA diving equipment for facilitating underwater speech by a diver using said SCUBA diving equipment, said mouthpiece comprising a lip cup for receiving the lips of the diver in selective speaking and non-speaking configuration; a connector attaching said lip cup to said SCUBA diving equipment; a pair of elongated jaw teeth grips extending from said lip cup and terminating at extending ends for gripping by the jaw teeth of the diver; an elongated speaker mount tube having one end connected in air communication to said connector, said speaker mount tube disposed at a selected angle with respect to said connector; and a mechanical underwater speaker connected in air communication to the opposite end of said speaker mount tube for facilitating underwater speech by the diver.

10. The mouthpiece and speaker assembly of claim 9 wherein said elongated jaw teeth grips are substantially flat and enlarged at the extending end thereof and are shaped to accommodate the teeth of the diver.

11. The mouthpiece and speaker assembly of claim 9 comprising a nipple provided in said connector for connecting said speaker mount tube to said connector.

12. The mouthpiece and speaker assembly of claim 9 wherein said elongated jaw teeth grips are substantially flat and enlarged at the extending end thereof and are substantially reverse-curved to accommodate the teeth of the diver and comprising a nipple provided in said connector for connecting said speaker mount tube to said connector.

13. The mouthpiece and speaker assembly of claim 9 wherein said speaker comprises a housing having at least one opening and a pair of flexible membranes joined at a common perimeter and mounted in said housing, said membranes provided in air communication with said passage for pulsing of said membranes responsive to said underwater speech by the diver.

14. A mouthpiece and speaker assembly in combination with snorkel diving equipment for facilitating underwater speech by a diver using the snorkel diving equipment, said mouthpiece comprising a lip cup; a connector attaching said lip cup in air communication to the snorkel diving equipment, said connector defining a first air flow passage between said lip cup and said snorkel diving equipment; a pair of elongated jaw teeth grips extending from said lip cup and terminating at extending ends for gripping by the jaw teeth of the diver and facilitating underwater speech; and a speaker provided in air communication with said connector for transferring sound waves from said lip cup to the water and facilitating the underwater speech, said connector defining a second air flow passage between said lip cup and said speaker with said second air flow passage at least partially separated from said first air flow passage, whereby air flows from the snorkel diving equipment to said lip cup through said first air flow passage and the sound waves travel from said lip cup to said speaker through said second air flow passage and enter said speaker separated from said first air flow passage.

15. The mouthpiece and speaker assembly of claim 14 wherein said elongated jaw teeth grips are substantially flat and enlarged at the extending end thereof and are shaped to accommodate the teeth of the diver.

16. The mouthpiece and speaker assembly of claim 14 comprising a nipple provided in said connector for connecting said speaker to said connector and wherein said second air flow passage is defined by said nipple.

17. The mouthpiece and speaker assembly of claim 14 wherein said elongated jaw teeth grips are substantially flat and enlarged at the extending end thereof and are shaped to accommodate the teeth of the diver and comprising a nipple provided in said connector for connecting said speaker to said connector and wherein said second air flow passage is defined by said nipple.

18. The mouthpiece and speaker assembly of claim 14 wherein said speaker comprises a housing provided in air communication with said connector and having at least one opening for receiving water, and a pair of flexible membranes sealed to each other along a common perimeter in said housing and provided in air communication with said lip cup for pulsing of said membranes responsive to the sound waves and transmitting the sound waves through the water.

19. The mouthpiece and speaker assembly of claim 14 wherein said speaker comprises a housing having at least one opening and a pair of membranes joined at a common perimeter and mounted in said housing, said membranes provided in air communication with said second air flow passage for pulsing of said membranes responsive to said underwater speech by the diver.

20. A mouthpiece and speaker assembly for optional attachment to diving equipment and facilitating underwater speech, said mouthpiece and speaker assembly comprising a lip cup; a connector provided in air communication with said lip cup; a housing provided in air communication with said connector, wherein the diving equipment is connected in air communication with said connector between said lip cup and said housing and said housing having at least one opening for receiving water; and a pair of adjacent flexible membranes provided in said housing in air-communication with said lip cup for pulsing of said membranes responsive to the underwater speech and transmitting the speech through the water said pair of adjacent, flexible membranes sealed to each other alone a common perimeter.

* * * * *